United States Patent [19]

Goldberg et al.

[11] Patent Number: 4,886,387

[45] Date of Patent: Dec. 12, 1989

[54] COSMETIC CONTAINER AND APPLICATOR

[75] Inventors: Ronald N. Goldberg, Coram; Eugene G. Mavroudis, Dix Hills; Susan H. Ferguson, Coram, all of N.Y.

[73] Assignee: Estee Lauder, Inc., New York, N.Y.

[21] Appl. No.: 616,126

[22] Filed: Jun. 1, 1984

[51] Int. Cl.[4] ..... A45D 40/00

[52] U.S. Cl. ..... 401/122; 132/320; 401/129

[58] Field of Search ..... 132/88.5, 88.7; 401/109, 115, 122, 274, 129

[56] References Cited

U.S. PATENT DOCUMENTS

| | | | |
|---|---|---|---|
| 63,841 | 4/1867 | Bly . | |
| 75,672 | 3/1868 | Ebaugh . | |
| 204,625 | 6/1878 | Silsbee . | |
| 424,539 | 4/1890 | Cole . | |
| 455,321 | 7/1891 | Greenwood . | |
| 565,328 | 8/1896 | Buhler . | |
| 822,235 | 6/1906 | Bailey . | |
| 1,021,709 | 3/1912 | Snow . | |
| 1,119,233 | 12/1914 | Boone . | |
| 1,655,950 | 1/1928 | Griswold . | |
| 1,867,494 | 7/1932 | Buchner . | |
| 2,124,058 | 7/1938 | Gannon | 91/67.2 |
| 2,141,327 | 12/1938 | Younghusband | 132/79 |
| 2,148,736 | 2/1939 | Engel, Jr. | 132/79 |
| 2,170,222 | 8/1939 | Strauss | 128/269 |
| 2,521,269 | 9/1950 | Turnes | 132/85 |
| 2,625,159 | 1/1953 | Roehrich | 128/267 |
| 2,630,593 | 3/1953 | Jockers | 401/115 |
| 2,783,489 | 3/1957 | Bogoslowsky | 15/140.4 |
| 2,832,981 | 5/1958 | Breuhan | 15/136 |
| 2,990,834 | 7/1961 | Amen | 132/85 |
| 3,033,213 | 5/1962 | Joss | 132/79 |
| 3,035,299 | 5/1962 | Gordon et al. | 15/537 |
| 3,071,143 | 1/1963 | Bau | 132/88.7 |
| 3,084,374 | 4/1963 | Ziegler | 15/521 |
| 3,130,735 | 4/1964 | Clark | 132/85 |
| 3,157,905 | 11/1964 | Levy | 15/527 |
| 3,195,545 | 7/1965 | Lederberg et al. | 132/79 |
| 3,209,388 | 10/1965 | Kamberksy | 15/521 |
| 3,214,782 | 11/1965 | Masters et al. | 15/521 |
| 3,219,045 | 11/1965 | Kambersky | 132/79 |
| 3,262,461 | 7/1966 | Kambersky | 132/79 |
| 3,280,421 | 10/1966 | Davidson | 15/520 |
| 3,363,635 | 1/1968 | Wurmbock | 132/88.7 |
| 3,384,547 | 5/1968 | Palmerio et al. | 167/85 |
| 3,415,604 | 12/1968 | Ahrens et al. | 401/122 |
| 3,469,928 | 9/1969 | Widegren | 401/122 |
| 3,471,244 | 10/1969 | Melocchi | 401/122 |
| 3,529,899 | 9/1970 | Gruska | 401/121 |
| 3,545,878 | 12/1970 | Bok | 401/260 |
| 3,549,266 | 12/1970 | Vasas | 401/122 |
| 3,588,263 | 6/1971 | Werding | 401/125 |
| 3,662,769 | 5/1972 | Vasas | 132/88.7 |

(List continued on next page.)

FOREIGN PATENT DOCUMENTS

| | | |
|---|---|---|
| 936816 | 11/1973 | Canada . |
| 2005504 | 8/1971 | Fed. Rep. of Germany . |
| 2210812 | 10/1973 | Fed. Rep. of Germany . |
| 2545952 | 4/1977 | Fed. Rep. of Germany . |
| 2722232 | 11/1978 | Fed. Rep. of Germany . |
| 1179724 | 1/1970 | United Kingdom . |
| 1545627 | 5/1979 | United Kingdom . |
| 2082553 | 3/1982 | United Kingdom . |
| 2097662 | 11/1982 | United Kingdom . |

*Primary Examiner*—Steven A. Bratlie

*Attorney, Agent, or Firm*—Richard M. Barnes

[57] ABSTRACT

Disclosed is an improved cosmetic container and applicator comprising: (a) a container having an open and a closed end; (b) an applicator including a cap, an elongated rod, and a brush; (c) an upper wiper element located at or near the open end of the container; and (d) a lower wiper element located further from the open end of the container than the first wiper element, the lower wiper serving to divide the container into two chambers. The upper wiper removes excess makeup from the brush when it is removed from the container and, preferably, also wipes the surface of the rod clean when the rod is removed from the container. The lower wiper cleans the brush after every use, thereby virtually eliminating the building up and drying of makeup that would otherwise occur on the brush.

29 Claims, 2 Drawing Sheets

U.S. PATENT DOCUMENTS

| | | | |
|---|---|---|---|
| 3,684,387 | 8/1972 | Glenn | 401/122 |
| 3,692,417 | 9/1972 | Aston | 401/122 |
| 3,756,731 | 9/1973 | Aubry | 401/122 |
| 3,763,870 | 10/1973 | Montgomery et al. | 132/85 |
| 3,764,221 | 10/1973 | Solenghi | 401/129 |
| 3,817,637 | 6/1974 | Vasas | 401/122 |
| 3,861,810 | 1/1975 | Vasas | 401/122 |
| 3,870,186 | 3/1975 | Reinhard | 220/212 |
| 3,883,254 | 5/1975 | Vasas | 401/122 |
| 3,891,330 | 6/1975 | Vasas | 401/122 |
| 3,892,248 | 7/1975 | Kingsford | 132/88.7 |
| 3,896,823 | 7/1975 | Spatz | 132/88.7 |
| 3,908,675 | 9/1975 | Spatz et al. | 132/82 R |
| 3,921,650 | 11/1975 | Montgomery | 132/88.7 |
| 3,930,280 | 1/1976 | Vasas | 15/257.05 |
| 3,951,157 | 4/1976 | Idec | 132/88.7 |
| 3,998,235 | 12/1976 | Kingsford | 132/88.5 |
| 4,135,527 | 1/1979 | Montiel | 132/88.7 |
| 4,175,574 | 11/1979 | Zulberti | 132/88.7 |
| 4,194,848 | 3/1980 | Kingsford | 401/5 |
| 4,241,743 | 12/1980 | Schnabel et al. | 132/88.7 |
| 4,261,376 | 4/1981 | Kingsford | 132/88.5 |
| 4,332,494 | 6/1982 | Kingsford | 401/5 |
| 4,390,298 | 6/1983 | Carluccio | 401/122 |
| 4,403,624 | 9/1983 | Montgomery | 132/88.7 |
| 4,404,977 | 9/1983 | Vasas | 132/88.7 |
| 4,407,311 | 10/1983 | Gueret | 132/88.5 |

COSMETIC CONTAINER AND APPLICATOR

BACKGROUND OF THE INVENTION

The present invention is directed to an improved cosmetic container and applicator system having two wiper elements and a brush at the end of an elongated rod. Each of the two wiper elements is specially designed to perform one or more specific functions. In particular, (a) the wiper element closest to an opening at one end of the container functions to remove excess cosmetic from the brush and, preferably, also removes cosmetic from the elongated rod, and (b) the wiper element furthest from the opening functions to remove substantially all of the cosmetic from the brush.

Cosmetic containers having a wiper system to remove cosmetic from an elongated rod and excess cosmetic from a brush that extends from the rod have been used commercially for a number of years. In such commercial containers, a cosmetic composition, such as mascara, is housed in a single chamber that also houses the applicator and single wiper element. The wiper is typically located near the opening of the container at its top. Cosmetic containers of this general type are depicted in a number of United States Patents (e.g., in U.S. Pat. Nos. 3,692,417, 3,870,186 and 3,896,823).

A number of structures having dual wipers for cleaning the applicator rod and removing excess cosmetic from the brush have also been suggested in the patent literature (e.g., in U.S. Pat. Nos. 3,469,928 and 4,403,624).

Cosmetic compositions, such as mascara, are characterized by a thick, paste-like consistency. One consequence of that paste-like consistency is that with continued use, mascara tends to build up and dry out on the brush assembly of cosmetic applicators like those described above. We believe that this occurs for at least the following four reasons:

(a) a significant amount of mascara remains on the brush assembly (particularly on the brush core and the portion of the brush bristles closest to the brush core) after the user applies mascara to the eyelashes and reinserts the brush into the container;

(b) the same mascara that is left remaining on the brush core and the portion of the brush bristles closest to the brush core in the preceding manner tends to remain there during repeated removals and reinsertions of the brush from and into the container;

(c) after a portion of the mascara in the container is removed, the volatile portion of the mascara that is left on the brush assembly upon reinsertion dries out, at least in part, into the air space in the container between the applicator brush and the mascara remaining in the container; and (d) this drying out is accelerated by the user's continued removal and reinsertion of the brush from and into the container, and the waving of the brush assembly during application of mascara to the lashes. The drying out of the mascara on the brush assembly in the foregoing manner can result in the deposition of dry chunks of the mascara on the user's lashes with consequent flaking off and smudging.

SUMMARY OF THE INVENTION

An object of the present invention is to provide an improved cosmetic container and applicator system for applying makeup, such as mascara.

Another object of the present invention is to provide an improved container and applicator system for mascara that substantially prevents the building up and drying out over time of mascara on the applicator brush.

Yet another object of the present invention is to provide a cosmetic container and applicator system that accomplishes the above objects, yet is convenient to use and is relatively easy and inexpensive to construct.

The above objects are achieved by the cosmetic container and applicator of the present invention, which comprises: (a) a container having an open end at its top and a closed end at its bottom; (b) an applicator including a brush at its bottom and an elongated rod that extends longitudinally upwardly from the brush; (c) an upper wiper element that is preferably located at or near the open end of the container; and (d) a lower wiper element located further from the open end of the container than the upper wiper element, the lower wiper serving to divide the container into a top chamber and an bottom chamber.

The bottom chamber of the container, that is, the chamber closest to the closed end of the container, is preferably smaller in length than the top chamber and, most preferably, is just large enough to house the applicator brush when the applicator is not in use. The bottom chamber may be empty; it may contain the same type of makeup as the top chamber, or it may contain another material such as a cleaning and/or disinfecting material. Preferably, the bottom chamber contains the same type of makeup as the top chamber.

The brush preferably comprises bristles disposed on a brush core which extends downwardly from the elongated rod. A particularly preferred brush assembly comprises a twisted wire assembly on which bristles are helically clamped. Brush assemblies of this type are described in a number of United States patents (e.g., in U.S. Pat. Nos. 3,469,928 and 3,692,417). As can be seen from the foregoing patents, the cross sectional dimension of the brush core (hereinafter referred to as the brush core diameter) is smaller than the diameter of the elongated rod from which it extends.

The upper wiper element serves to remove excess makeup from the brush when the applicator is removed from the container. In addition, in preferred embodiments, the upper wiper is designed to wipe the elongated rod as well as to remove excess makeup from the brush. In contrast, the lower wiper element performs a different function than does the upper wiper element. Specifically, the lower wiper element cleans the brush by removing substantially all the makeup from the brush as it is moved in either direction past the lower wiper element.

In use, the brush is moved by the user through a series of positions. Initially, when the system is closed, the brush is positioned in the bottom chamber beneath the lower wiper element. The user first moves the brush past the lower wiper and into the top chamber. There, the user swirls and/or pivots the brush, in a manner described in more detail hereinafter, to pick up makeup, such as mascara, from the interior of the top chamber onto the brush. The brush is then moved past the upper wiper element and out of the container where the user may apply the makeup. After application of the makeup, the user returns the brush to its original position in the lower chamber. It will be appreciated that because the lower wiper removes substantially all of the makeup from the brush when the brush is returned to or moved out of the bottom chamber, fresh makeup is applied to the lashes on each application, rather than dried out makeup as can occur with the use of the prior art devices described above.

The upper and lower wiper elements are appropriately dimensioned and constructed of suitable materials to accomplish the foregoing purposes. In particular, the upper wiper element comprises a wiping surface, which defines a first opening that is dimensioned to engage the elongated rod as it is moved out of the container. The lower wiper element comprises a wiping surface that defines a second opening, which is smaller than the first opening, and which is dimensioned about the size of the brush core. Preferably: (a) the lower wiper element is made of a relatively hard, non-resilient material to facilitate the removal of makeup from the brush on the inward and outward strokes of the brush, and (b) the upper wiper element is made of a relatively more resilient material than the lower wiper element.

Preferably, the lower wiper, and most preferably both wipers have a frusto-conical shape that converges inwardly from the walls of the container in a direction away from the opening at the top of the container. By shaping the wiper elements in this manner, the brush is guided through the openings defined by the wiper elements on the inward stroke of the brush.

DESCRIPTION OF THE PREFERRED EMBODIMENTS

Figure 1:
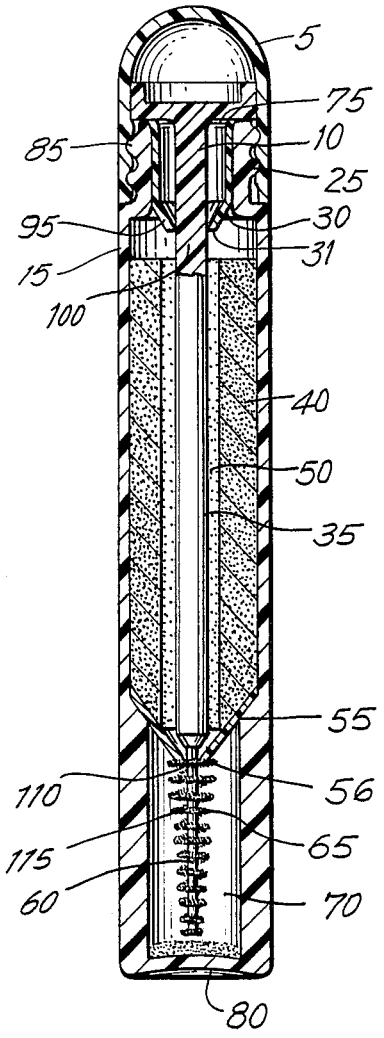
FIG. 1 shows a longitudinal sectional view of a preferred embodiment of our invention when the container is in a closed position and contains a full load of makeup.
Figure 2:
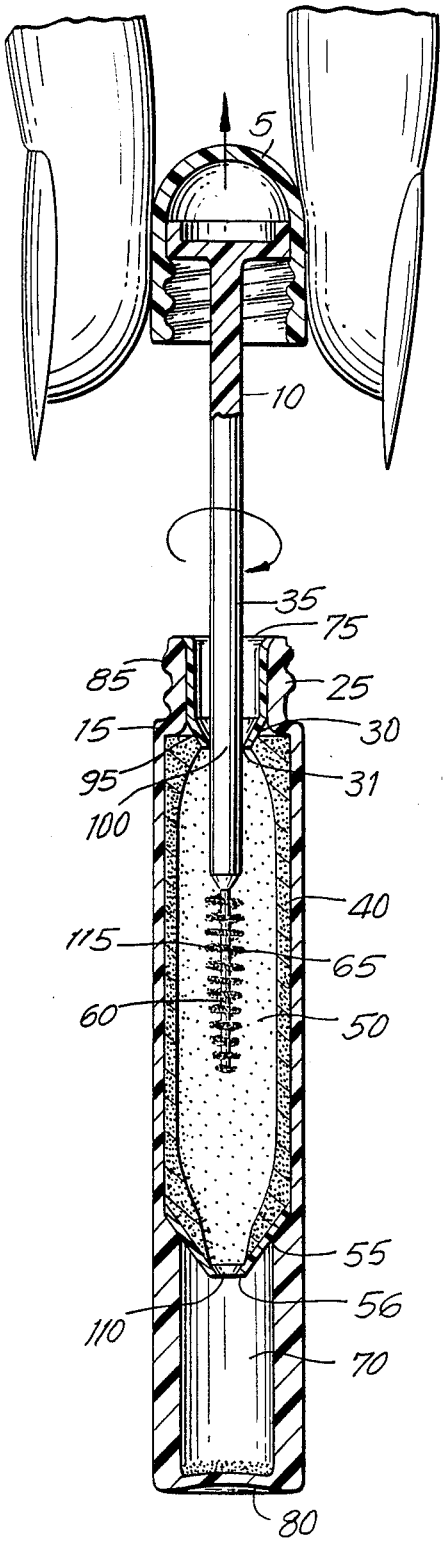
FIG. 2 is a view similar to that shown in FIG. 1 except that the container is in a partially opened position and has had a portion of its original supply of makeup removed.

Referring to FIGS. 1 and 2, there are shown two views of a preferred embodiment of our invention. In FIG. 1, the container is closed and its upper chamber contains a full load of makeup, such as mascara. In FIG. 2, the container is partially opened and a portion of the makeup supply originally in the container has been removed. In both figures, the makeup is designated by the reference numeral 40 and is depicted by dots.

As shown in FIGS. 1 and 2, our improved cosmetic container and applicator comprises container 15, an applicator generally designated 10, a first wiper element 30, and a second wiper element 55.

Applicator 10 comprises a cap 5 from which extends elongated rod 35 which has secured thereto brush 65. In use, cap 5 functions as a handle.

Brush 65 includes a brush core 60 having disposed thereon bristles 115. Bristles 115 are disposed on brush core 60 in a helical fashion as described in the previously cited U.S. Pat. Nos. 3,469,928 and 3,692,417.

Container 15 is hollow and has a closed end 80 and an open end 75 that includes an annular neck 25. Neck 25 is preferably provided with external threads 85, which are engageable with the internal threads of cap 5 when the container is in a closed positio.

Secured within neck 25 is upper wiper element 30 having wiping surface 31 which defines a centrally positioned opening 100 therethrough. Upper wiper 30 may be secured to neck 25 by any suitable technique, e.g., by friction fit or by the use of an adhesive.

As shown in FIGS. 1 and 2, lower portion 95 of wiper element 30 is frusto-conical in shape so that in use when the brush is reinserted into the container it is guided into opening 100 by the upper surface of frusto-conical portion 95 of upper wiper element 30. Opening 100 is dimensioned to circumferentially engage applicator rod 35 to wipe the rod clean and to engage brush 65 to remove excessive makeup from the brush when the applicator is removed from the container.

Upper wiper element 30 is preferably made of a resilient material that is relatively flexible as compared to the preferred materials used to construct the second, lower wiper described below. Preferred materials that may be used to construct the upper wiper are "BUNA" (a synthetic rubber comprising a copolymer of acrylonitrile and butadiene), neoprene, low density polyethylene, and polyurethane.

Secured to the inner wall of container 15 at a position further from open end 75 of container 15 than wiper element 30 is lower wiper element 55. Lower wiper element 55 may be secured to the inner wall by any technique (e.g., by the use of an adhesive) that ensures that the lower wiper element remains in place during the use of the container. The inner wall of the container may be slanted inwardly as depicted in FIGS. 1 and 2 to facilitate securing the lower wiper element to the inner wall.

As shown, lower wiper element 55 preferably is frusto-conically shaped. Lower wiper element 55 includes a wiping surface 56 that defines a centrally positioned opening 110 therethrough. Opening 110, which is smaller than opening 100, is dimensioned to engage severely brush 65 and thereby remove substantially all makeup from the brush and brush core when the brush is forced through the opening in either direction. As shown in FIG. 1, when the container is in its closed position, wiping surface 56 of lower wiper element 55 is positioned just underneath the bottom of elongated rod 35. As with upper wiper 30, the frusto-conically shaped section of lower wiper 55 functions to guide the brush into opening 110 during reinsertion of the brush.

Lower wiper 55 is preferably made of a relatively rigid material as compared to the material from which the upper wiper is preferably made. For example, the lower wiper may be made from high density polyethylene, polypropylene, polyvinyl chloride, or "SAN" (a styrene acrylonitrile thermoplastic resin). Lower wiper 55 is typically less resilient than upper wiper 30.

As shown in FIGS. 1 and 2, lower wiper 55 divides container 15 into a top chamber 50 and a bottom chamber 70. Top chamber 50 contains a supply of makeup 40 with which the applicator is brought into contact during use. Because the makeup that is to be used in the container (e.g., mascara) has a paste-like consistency, in use the makeup does not fall to the bottom of the container.

Bottom chamber 70 need only be large enough to house brush 65. Thus, bottom chamber 70 may have a diameter equal to that of the upper chamber or its diameter may be reduced in size as shown in FIGS. 1 and 2. Bottom chamber 70 may be filled with the same cosmetic as upper chamber 50 or with another material (e.g., a cleaning and/or disinfecting material) or it may contain merely air. As shown, the bottom chamber contains air.

Container 15 need not be constructed as a unitary structure as depicted in FIGS. 1 and 2. For example, container 15 may comprise separately constructed top and bottom, cartridges that are securely engaged (e.g., by screwing the two cartridges together in a separate step) during the manufacture of the completed container.

FIG. 2 shows the arrangement of the parts of the container and applicator of the invention when the brush has been partially removed from the container and after a portion of the original supply of the makeup has been removed from the container. As previously discussed, then brush 65 is moved in either direction through lower wiper 55, substantially all product that was previously on the brush is removed. Thus, when the brush is moved from bottom chamber 70 into top chamber 50, the brush is initially clean. The user then swirls and/or pivots elongated rod 35 about top, chamber 50 to move the brush into contact with the makeup in the container, thereby picking up makeup on the brush. The rod and brush are then moved through opening 100 in upper wiper 30 thereby cleaning rod 35 and removing excess cosmetic from brush 65. After application of cosmetic to the lashes, applicator 10 is returned to the container. As brush 65 is reinserted from top chamber 50 into bottom chamber 70 through opening 110 in lower wiper 55, substantially all of the cosmetic is removed from the brush. As is apparent from the foregoing discussion, there is virtually no mixing of the contents of the two chambers.

When the container of the invention is in the closed position, the brush is located in the bottom chamber. If the bottom chamber is empty, the brush, which is virtually free of cosmetic, is in contact with a small amount of air. If the lower chamber is full, the brush is immersed in the product contained therein. In both cases, the unwanted buildup of cosmetic on the brush core and the resultant drying out and caking of cosmetic on the brush and brush core have been substantially eliminated. Thus, the user is provided with the equivalent of a fresh new brush for each application.

Figure 3:
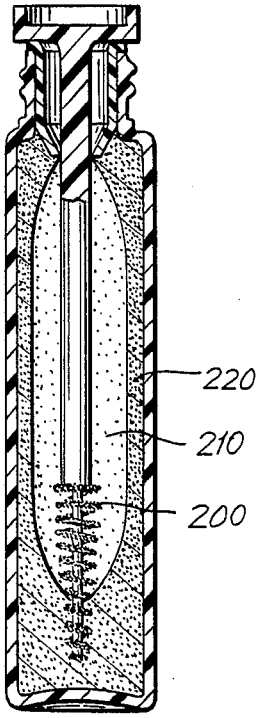
FIG. 3 PRIOR ART
FIG. 3 shows a longitudinal sectional view of a prior art type of makeup container, with the container in a closed position and with a portion of its original supply of makeup removed.

The foregoing is in sharp contrast to what occurs when prior art containers, like those described above, are used. Such a prior art container is depicted in FIG. 3, in which the container is in a closed position and a portion of its original supply of makeup has been removed. As shown in FIG. 3, the upper portion of brush. 200 is exposed to the air space 210 between the brush and the makeup 220 remaining in the container. Because the device depicted in FIG. 3 does not have a second wiper element for removing substantially all makeup from brush 200, the upper portion of brush 200 contains residual makeup embedded therein, particularly on the upper portion of the core and the inner portions of the brush bristles. The volatile portion of this residual makeup is free to evaporate over time into previously mentioned air space 210 as well as into the surrounding atmosphere when the applicator is being used. This evaporation results in drying out of the residual makeup on the brush and brush core, which leads to flaking off and smudging of the makeup during subsequent use.

What we claim is:

1. A cosmetic container and applicator comprising:

(a) a container having an opening at its top for reciprocably receiving the applicator specified in subparagraph (b) hereof;

(b) an applicator comprising a brush at its bottom and an elongated rod that extends longitudinally upwardly from the brush;

(c) an upper wiper element, said upper wire element comprising a wiping surface that defines a first opening through which the elongated rod and brush of the applicator may pass, the first opening in said upper wiper element being dimensioned to engage the brush to remove excessive makeup from the brush when the brush is moved out of the container;

(d) a lower wiper element, said lower wiper element being positioned further from the opening of the container than the upper wiper element, said lower wiper element dividing the container into a top chamber and a bottom chamber, and having a wiping surface which defines a second opening through which the brush may pass, said second opening having a smaller dimension than that of the first opening, said second opening being dimensioned to engage the brush as it passes through the opening so as to remove substantially all of the makeup from said brush as it is passed therethrough, and further wherein said top chamber contains makeup.

2. The cosmetic container and applicator of claim 1 wherein the bottom chamber contains makeup.

3. The cosmetic container and applicator of claim 2 wherein the makeup in the top and bottom chambers is mascara.

4. The cosmetic container and applicator of claim 1 wherein the bottom chamber does not contain makeup.

5. The cosmetic container and applicator of claim 4 wherein the makeup is mascara.

6. The cosmetic container and applicator of claim 4 wherein the bottom chamber contains a material for cleaning makeup from the brush.

7. The cosmetic container and applicator of claim 4 wherein the bottom chamber contains a material for disinfecting the brush.

8. The cosmetic container and applicator of claim 1 wherein the upper wiper element is dimensioned to engage the elongated rod of the applicator to remove makeup from said rod when the rod is moved out of said container.

9. The cosmetic container and applicator of claim 1 wherein the second opening is dimensioned smaller than the diameter of the elongated rod of the applicator.

10. The cosmetic container and applicator of claim 1 wherein the upper wiper element comprises a frustoconical portion that converges inwardly of the inside wall of the container in a direction away from the top of the container.

11. The cosmetic container and applicator of claim 1 wherein the lower wiper element comprises a frustoconical portion that converges inwardly of the inside wall of the container in a direction away from the top of the container.

12. The cosmetic container and applicator of claim 10 wherein the lower wiper element comprises a frustoconical portion that converges inwardly of the inside wall of the container in a direction away from the top of the container.

13. The cosmetic container and applicator of claim 1 wherein the upper wiper element is made of a material that is more resilient than the material from which the lower wiper element is made.

14. The cosmetic container and applicator of claim 1 wherein when the brush is fully inserted into the bottom chamber, the wiping surface of the lower wiper element is positioned beneath the elongated rod.

15. The cosmetic container and applicator of claim 1 wherein the bottom chamber is about the same length as the brush.

16. The cosmetic container and applicator of claim 14 wherein the brush comprises bristles disposed on a brush core.

17. The cosmetic container and applicator of claim 16 wherein the diameter of the brush core is smaller than the diameter of the elongated rod.

18. A cosmetic container and applicator comprising:

(a) a container for holding makeup having a neck and an opening at its top;

(b) an applicator comprising a handle at its top, a brush at its bottom, and an elongated rod having a longitudinal axis that extends between the handle and the brush, the brush and the rod being adapted to be moved into and out of the container through the opening in the container;

(c) an upper wiper element, said upper wiper element comprising a wiping surface that defines a first opening through which the rod and brush of the applicator may pass, said first opening in said upper wiper element being dimensioned to engage the brush to remove excess makeup from the brush when the brush is moved out of the container; and (d) a lower wiper element said lower wiper element being positioned further from the opening of the container than the upper wiper element, said lower wiper element dividing said container into a top chamber and a bottom chamber, and having a wiping surface that defines a second opening through which the brush may pass, said second opening being dimensioned smaller than the first opening so that in use substantially all of the makeup on the brush is removed therefrom when the brush is moved through the second opening, and further wherein said top chamber contains makeup.

19. The cosmetic container and applicator of claim 18 wherein the upper wiper element is dimensioned to engage the elongated rod of the applicator to remove makeup from said rod when the rod is moved out of said container.

20. The cosmetic container and applicator of claim 19 wherein the lower wiper element comprises a frustoconical portion that converges inwardly of the inside wall of the container in a direction away from the top of the container.

21. The cosmetic container and applicator of claim 20 wherein the upper wiper element comprises a frustoconical portion that converges inwardly of the inside wall of the container in a direction away from the top of the container.

22. The cosmetic container and applicator of claim 21 wherein when the brush is fully inserted into the bottom chamber the wiping surface of the lower wiper element is positioned beneath the elongated rod.

23. The cosmetic container and applicator of claim 22 wherein the brush comprises bristles disposed on a brush core.

24. The cosmetic container and applicator of claim 23 wherein the bottom chamber is about the same length as the brush.

25. The cosmetic container and applicator of claim 24 wherein the diameter of the brush core is smaller than the diameter of the elongated rod.

26. The cosmetic container and applicator of claim 25 wherein both the top and bottom chambers contain mascara.

27. The cosmetic container and applicator of claim 18 wherein both the top and bottom chambers contain mascara.

28. The cosmetic container and applicator of claim 18 wherein the top chamber contains mascara and the bottom chamber contains a material for cleaning makeup from the brush.

29. The cosmetic container and applicator of claim 18 wherein the top chamber contains mascara and the bottom chamber contains material for disinfecting the brush.

* * * * *

UNITED STATES PATENT AND TRADEMARK OFFICE

CERTIFICATE OF CORRECTION

PATENT NO. : 4,886,387

DATED : December 12, 1989

INVENTOR(S) : Ronald N. Goldberg, Eugene G. Mavroudis, Susan H. Ferguson

It is certified that error appears in the above-identified patent and that said Letters Patent is hereby corrected as shown below:

| Column | Line | Error |
|---|---|---|
| 5 | 13 | Change "then" to --when-- |

Signed and Sealed this

Eighteenth Day of June, 1991

*Attest:*

HARRY F. MANBECK, JR.

*Attesting Officer*

*Commissioner of Patents and Trademarks*